US005503223A

United States Patent [19]

Choi et al.

[11] Patent Number: 5,503,223

[45] Date of Patent: Apr. 2, 1996

[54] SINGLE TANK EVAPORATOR CORE HEAT EXCHANGER

[75] Inventors: Benjamin J. Choi, Plymouth; Stephen A. Hoynacki; Allan J. Kleve, both of Canton; Corey P. Small, Plymouth; Jay D. Siegler, Canton, all of Mich.

[73] Assignee: Ford Motor Company, Dearborn, Mich.

[21] Appl. No.: 419,567

[22] Filed: Apr. 10, 1995

[51] Int. Cl.[6] ..... F28D 1/03

[52] U.S. Cl. ..... 165/153; 165/176

[58] Field of Search ..... 165/152, 153, 165/176

[56] References Cited

U.S. PATENT DOCUMENTS

| | | | |
|---|---|---|---|
| 4,821,531 | 4/1989 | Yamauchi et al. . | |
| 5,024,269 | 6/1991 | Noguchi et al. . | |
| 5,042,577 | 8/1991 | Suzumura | 165/153 |
| 5,137,082 | 8/1992 | Shimoya et al. . | |
| 5,172,759 | 12/1992 | Shimoya et al. . | |
| 5,203,407 | 4/1993 | Nagasaka . | |

FOREIGN PATENT DOCUMENTS

| | | | |
|---|---|---|---|
| 120253 | 9/1943 | Australia . | |
| 1118093 | 5/1989 | Japan . | |
| 2272298 | 11/1990 | Japan . | |
| 3-122470 | 5/1991 | Japan | 165/176 |

*Primary Examiner*—Allen J. Flanigan

*Attorney, Agent, or Firm*—Raymond L. Coppiellie; Roger L. May

[57] ABSTRACT

A heat exchanger including a core formed by a plurality of elongated plates joined together in pairs to define a series of passageways and a single tank. The tank has at least three separate fluid flow tunnels in fluid communication with the passageways to move fluid through the core. Each of the fluid flow tunnels includes an aperture extending through at least a portion of each of he tunnels. At least one of the fluid flow tunnels is offset from the others such that the centerline of the aperture associated with the offset tunnel lies outside a plane containing the centerline of the apertures through the other tunnels.

18 Claims, 2 Drawing Sheets

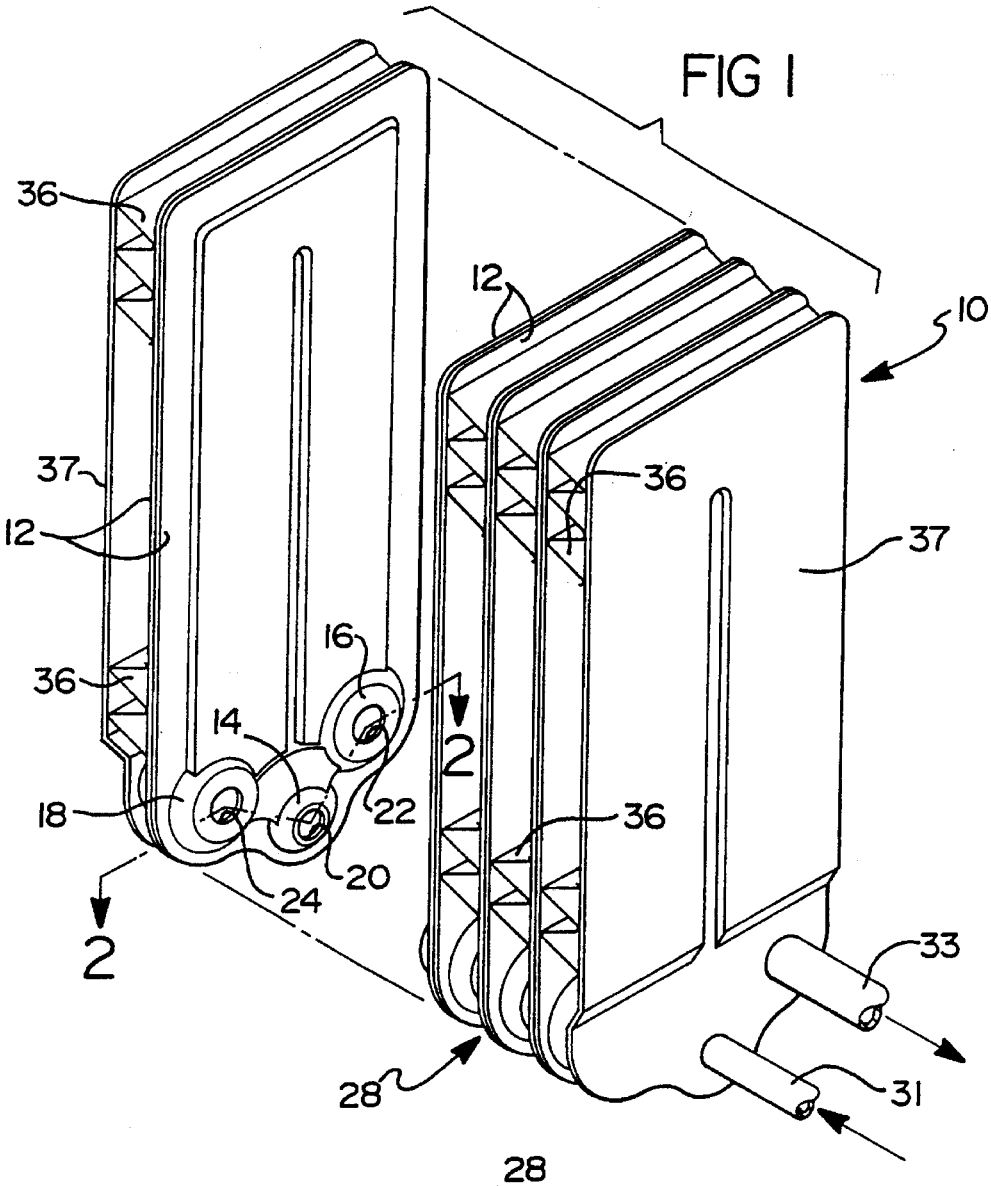
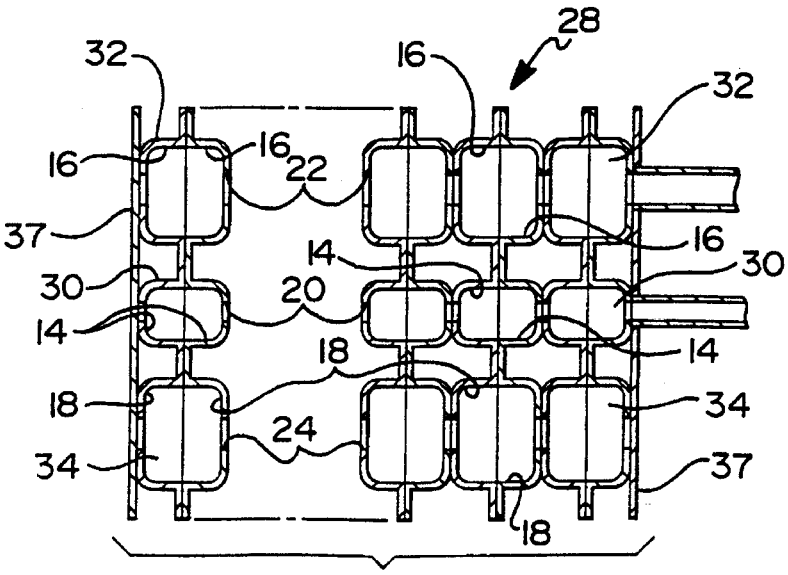
FIG 2

FIG 3
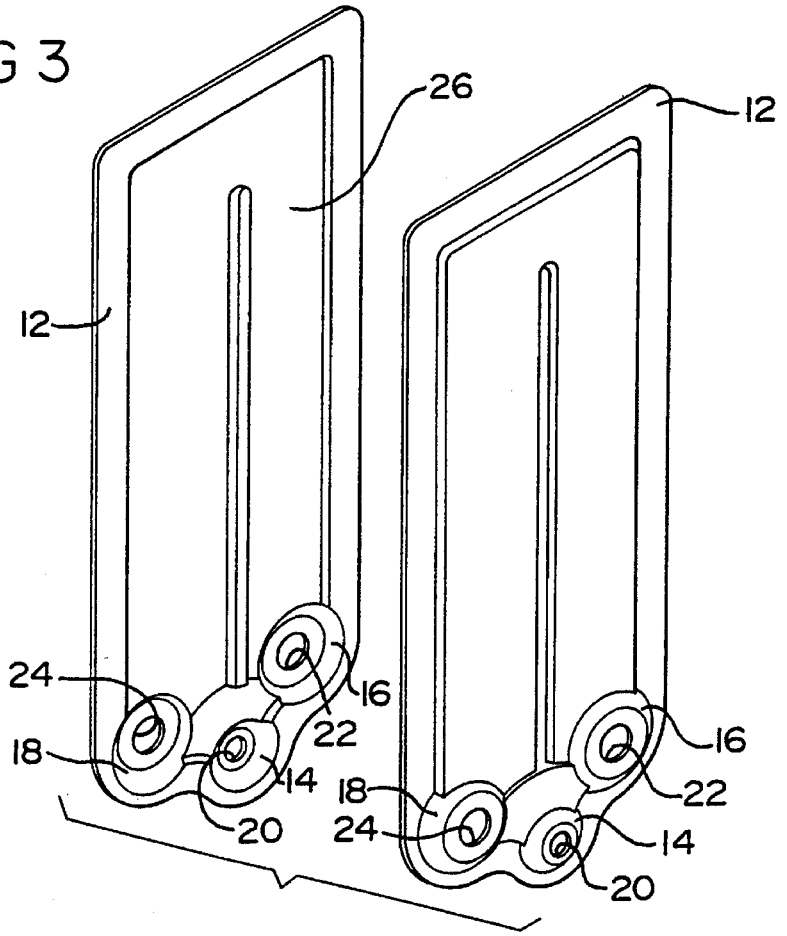
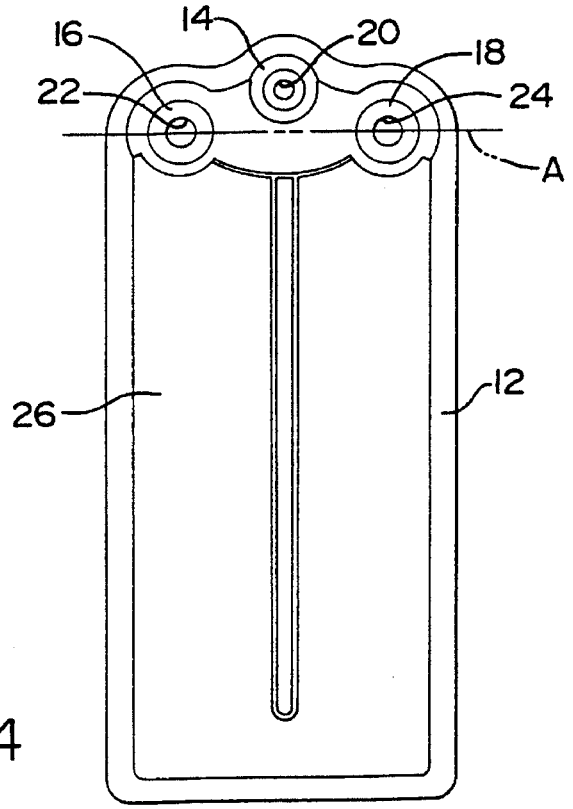
FIG 4

SINGLE TANK EVAPORATOR CORE HEAT EXCHANGER

BACKGROUND OF THE INVENTION

1. Field of the Invention

The present invention relates, generally, to a heat exchanger for a refrigeration/air conditioning system. More particularly, the present invention relates to a single tank evaporator core heat exchanger in an air conditioning system for an automotive vehicle.

2. Description of the Related Art

Plate-fin heat exchangers are well known in the art. In these types of heat exchangers, a plurality of elongated plates are joined together, such as through brazing or a lamination process to define a plurality of passageways for the movement of a fluid therethrough. Each of the passageways is formed by the inwardly facing surface of a pair of joined plates so as to form a flat tube. The passageways are interconnected so that a fluid may flow through the plurality of joined plates forming the heat exchanger. The joined plates also define central fluid conducting sections or "tanks" as they are commonly known in the art. The heat exchanger may employ a single tank disposed on one end thereof or a pair of tanks disposed at opposite ends of the evaporator core. As is also known in the art, conductive fin strips are located between outwardly facing surfaces of the pair of joined plates. Heat exchangers of this type have particular utility as evaporators for air conditioning systems of motor vehicles.

Typically, plate-fin heat exchangers are manufactured by stacking a plurality of individual plate together to form a flat tube and interleaving fin members between each tube. Endsheets are then placed on opposite ends of the heat exchanger to form a heat exchanger core. An inlet and outlet manifold are then inserted into an aperture formed in the endsheet or tank to provide for fluid communication into and out of the evaporator. The core is braised in a furnace to complete the manufacturing process.

In automotive applications, space is always at a premium and therefore the size configuration or "packaging" of the heat exchanger is an important consideration. To that end, it has been found that evaporator cores having a single tank are more efficient than dual tank designs. This is because the effective face area or the amount of space in the overall package of the heat exchanger dedicated to the passageways can be maximized in a single tank design thus increasing the heat transfer efficiency. In addition, and among single tank heat exchanger designs, efforts have been made to further maximize their efficiency. For example, single tank designs having three separate refrigerant flow tunnels in the tank have been employed in the past. Each plate is formed with two cups which, when joined to a confronting plate, form two flow tunnels. A tubular manifold extending through an aligned aperture in the plates may be employed for either the inlet or outlet to form the other or third flow tunnel in the tank. Such manifolds require additional brazing between the tubular manifold and the plates to secure the manifold within the evaporator core. This involves an additional step in the manufacturing process and may possibly result in leakage if a good brazed joint is not formed.

Other designs have been proposed wherein the tubular manifold is eliminated and another or third cup is formed in each plate, aligned side-by-side such that the centerline of the aperture extending through each flow tunnel is contained in the same plane. However, in practice it has been found impractical to manufacture such single tank, three cup heat exchangers while maintaining optimum size and packaging considerations. This is because of the limitation of the ductility of the plates. More specifically, during the manufacturing process, the material in and surrounding the cups is thinned as it is drawn during the stamping process to such an extent that the heat exchanger may fail at the tanks when subjected to elevated pressures. Further, the plates may fail or break at the stamping stage due to extreme draws in the stamped plate. However, spacing the cups relative to one another laterally across the plate is unacceptable because this increases the width of the heat exchanger thereby increasing the overall package of the evaporator core.

Accordingly, it would be advantageous to provide a single tank evaporator core having three cups which eliminates the need for a separate tubular manifold brazed to successive plates to serve as an inlet or outlet. Furthermore, it would be advantageous to provide a single tank evaporator core which may be consistently manufactured and which reaches failure at the cups in the tank due to thinning or breakage of the plate material.

SUMMARY OF THE INVENTION

The present invention overcomes the disadvantages discussed above by providing a heat exchanger including a core formed by a plurality of elongated plates joined together in pairs to define a series of passageways and a single tank. The tank has at least three separate fluid flow tunnels in fluid communication with the passageways to move fluid through the core. Each of the fluid flow tunnels includes an aperture extending through at least a portion of each of the tunnels. At least one of the fluid flow tunnels is offset from the others such that the centerline of the aperture associated with the offset tunnel lies outside a plane containing the centerline of the apertures through the other tunnels. By offsetting at least one of the fluid flow tunnels, a heat exchanger may be consistently and cost effectively manufactured having three cups but which eliminates the need for a separate tubular manifold brazed to successive plates to serve as an inlet or outlet. This also provides for design flexibility in refrigerant flow circuitry thus enabling maximum performance optimization Without increasing overall package area.

It is an advantage of the present invention to provide a heat exchanger for an automotive air conditioning system which lowers manufacturing costs while increasing the efficiency of the heat exchanger. These and other objects, features and advantages of the present invention will become apparent from the drawings, description and claims which follow.

BRIEF DESCRIPTION OF THE DRAWINGS

FIG. 1 is a partial perspective view of the heat exchanger of the present invention;

FIG. 2 is a cross-sectional view taken substantially along lines 2—2 of FIG. 1;

FIG. 3 is an assembly view of a pair of elongated plates to be joined together to define the passageways and tank of the heat exchanger of the present invention;

FIG. 4 is a plan view of an elongated plate employed in the present invention;

DESCRIPTION OF THE PREFERRED EMBODIMENT(S)

Referring now to the drawings, FIG. 1 shows a plate-fin heat exchanger, generally designated at 10, in the form of an evaporator particularly adapted for use in an automotive air conditioning system. The heat exchanger 10 includes a core formed by a plurality of elongated plates 12. Each of the plates 12 include at least three cups, 14, 16, 18 as best shown in FIGS. 3 and 4. The cups 14, 16, 18 each include an aperture 20, 22, 24, respectively, extending therethrough. The plates 12 are joined together in abutting face to face relationship so that adjacent pairs of the plates 12 define a series of alternate passageways 26 for the flow of refrigerant therethrough. In addition, the joined plates 12 also form a single tank, generally indicated at 28 in FIGS. 1 and 2, and having at least three separate fluid flow tunnels 30, 32, 34 formed by the confronting cups. As such, each of the fluid flow tunnels 30, 32, 34 include aligned apertures 20, 22, 24 corresponding to the cups 14, 16, 18 and extending through at least a portion of each of the tunnels 30, 32, 34. The tunnels 30, 32, 34 are in fluid communication with the passageways 26 to move fluid through the core. The plates 12 may be joined in any of a variety of known processes, such as through brazing or lamination process using either vacuum or controlled atmosphere ovens. Heat transfer fins 36 are positioned between pairs of plates to provide increased heat transfer area as is well known in the art. The pairs of plates and fin assemblies are contained within generally planar endsheets 37.

The three fluid flow tunnels include an inlet tunnel 30 for delivering fluid into the core. An inlet manifold 31 is in fluid communication with the inlet tunnel 30. In addition, the fluid flow tunnels include an outlet tunnel 32 for delivering fluid out of the core. The outlet tunnel 32 is in fluid communication with an outlet manifold 33 provided for that purpose. A transfer tunnel 34 is employed for delivering fluid between the inlet tunnel 30 and the passageways 26 and between the passageways 26 and the outlet tunnel 34. Refrigerant enters the core through the inlet manifold 31 into the inlet tunnel 30 where it is then conveyed to the transfer tunnel 34 at a predetermined point along the inlet tunnel 30. The refrigerant is then channelled through the passageways in a flow circuitry and, ultimately, into the outlet tunnel 32 and its corresponding outlet manifold 33.

As best shown in FIGS. 1, 3 and 4, at least one of the fluid flow tunnels is offset from the others such that the centerline of the aperture associated with the offset fluid flow tunnel lies outside a plane containing the centerlines of the apertures through the other fluid flow tunnels. More specifically, and as shown in the figures, the inlet tunnel 30 is offset from a plane A containing the centerlines of the apertures 22 and 24 extending through the outlet and the transfer tunnels 32 and 34.

Alternatively, it should be appreciated that the outlet tunnel 32 is offset from a plane containing the centerlines of the apertures 20 and 24 extending through the inlet and transfer tunnels 30 and 34. Similarly, the transfer tunnel 34 is offset from a plane containing the centerlines of the apertures 20 and 22 of the inlet and outlet tunnels 30 and 32. Thus, no single plane will include the centerlines of the apertures 20, 22, 24 of all three tunnels 30, 32, 34.

As best shown in FIG. 2, the inlet tunnel 30 is smaller than the outlet and transfer tunnels 32 and 34. This structure accommodates the refrigerant which enters the core as a liquid having a relatively small specific volume and expands over the course of moving through the passages 26 as it absorbs heat. The three cups 20, 22, 24 are circular in plan as shown in the figures. The cup 20 associated with the inlet tunnel 30 is smaller than the cups 22, 24 of the outlet and transfer tunnels 32, 34 respectively. Alternatively, the cups 20, 22, 24 may be oval in plan or any other geometric shape. The outlet tunnel 32 is sized for minimum pressure drop and maximum expansion through the heat exchanger 10. Furthermore, the mating surfaces or the cup to cup/plate to plate contact between the joined pairs of plates 12 are configured to provide optimum B geometry or braze surface.

The manufacture of the plate-fin heat exchanger 10 is accomplished as follows: The elongated plates 12 are generally formed from an aluminum material in a stamping process and then coated with an aluminum brazing alloy. The various components forming the entire unit are made from aluminum stock, then assembled as shown in FIGS. 1–3 and passed through a vacuumed or controlled atmosphere brazing operation in which the metal brazes together to form an integrated unit. Alternatively, other known processes may be used to manufacture the heat exchanger 10. The fabrication of the heat exchanger 10 is not meant to be limited to a specific manufacturing process.

In this way, a heat exchanger having a single tank but three cups forming three separate fluid flow tunnels may be consistently, efficiently and cost effectively manufactured without the need for a separate inlet or outlet tube brazed to the plates as is required in the related art. The present invention provides for design flexibility in refrigerant flow circuitry thus enabling maximum performance optimization without increasing overall package area. Furthermore, a heat exchanger having a single tank, three cup and three fluid flow tunnel configuration may be manufactured within stamping tolerances of the materials employed for such heat exchanger cores.

Various modifications and alterations of the present invention will, no doubt, occur to those skilled in the art, to which this invention pertains. These and all other variations which rely upon the teachings by which this disclosure has advanced the art are properly considered within the scope of this invention as defined by the appended claims.

What is claimed is:

1. A heat exchanger comprising;

a core formed by a plurality of elongated plates joined together in pairs to define a series of passageways and a single tank having at least three separate fluid flow tunnels in fluid communication with said passageways to move fluid through said core;

each of said fluid flow tunnels including an aperture extending through at least a portion of each of said tunnels, at least one of said fluid flow tunnels offset from the others such that a centerline of said aperture associated with said offset tunnel lies outside a plane containing a centerline of said apertures through said other tunnels.

2. A heat exchanger as set forth in claim 1 wherein said at least three fluid flow tunnels includes an inlet tunnel for delivering fluid into said core, an outlet tunnel for delivering fluid out of said core and a transfer tunnel for delivering fluid between said inlet and said passageways and between said passageways and said outlet tunnel.

3. A heat exchanger as set forth in claim 2 wherein said inlet tunnel is offset from a plane containing the centerlines of said apertures extending through said outlet and said transfer tunnels.

4. A heat exchanger as set forth in claim 2 wherein said outlet tunnel is offset from a plane containing the centerlines of said apertures extending through said inlet and said transfer tunnels.

5. A heat exchanger as set forth in claim 2 wherein said transfer tunnel is offset from a plane containing the centerlines of said apertures of said inlet and outlet tunnels.

6. A heat exchanger as set forth in claim 2 wherein said inlet tunnel is smaller than said outlet tunnel.

7. A heat exchanger as set forth in claim 2 wherein said inlet tunnel is smaller than said transfer tunnel.

8. A heat exchanger comprising;

a core formed by a plurality of elongated plates including at least three cups, a plurality of said cups having an aperture extending therethrough, said plates joined together in pairs to define a series of passageways and a single tank having at least three separate fluid flow tunnels formed by confronting cups, said tunnels in fluid communication with said passageways to move fluid through said core; and at least one of said fluid flow tunnels being offset from the other such that a centerline of said aperture associated with said offset fluid flow tunnel lies outside a plane containing centerlines of said apertures through said fluid flow tunnels.

9. A heat exchanger as set forth in claim 8 wherein said at least three fluid flow tunnels includes an inlet tunnel for delivering fluid into said core, an outlet tunnel for delivering fluid out of said core and a transfer tunnel for delivering fluid between said inlet and said passageways and between said passageways and said outlet tunnel.

10. A heat exchanger as set forth in claim 9 wherein said inlet tunnel is offset from a plane containing the centerlines of said apertures extending through said outlet and said transfer tunnels.

11. A heat exchanger as set forth in claim 9 wherein said outlet tunnel is offset from a plane containing the centerlines of said apertures extending through said inlet and said transfer tunnels.

12. A heat exchanger as set forth in claim 9 wherein said transfer tunnel is offset from a plane containing the centerlines of said apertures of said inlet and outlet tunnels.

13. A heat exchanger as set forth in claim 9 wherein said inlet tunnel is smaller than said outlet tunnel.

14. A heat exchanger as set forth in claim 9 wherein said inlet tunnel is smaller than said transfer tunnel.

15. A heat exchanger as set forth in claim 8 wherein said at least three cups are circular.

16. A heat exchanger as set forth in claim 8 wherein said at least three cups are oval.

17. A heat exchanger comprising;

a core formed by a plurality of elongated plates joined together in pairs to define a series of passageways and a single tank including an inlet tunnel for delivering fluid into said core, an outlet tunnel for delivering fluid out of said core and a transfer tunnel for delivering fluid between said inlet and said passageways and between said adjacent passageways and said outlet tunnel to move fluid through said core;

each of said tunnels including an aperture extending through at least a portion of each of tunnels, said inlet tunnel offset from said outlet and said transfer tunnels such that a centerline of said aperture associated with said inlet tunnel lies outside a plane containing a centerline of said apertures associated said outlet and inlet tunnels.

18. A heat exchanger as set forth in claim 17 wherein said inlet tunnel is smaller than said outlet and said transfer tunnels.

* * * * *